United States Patent [19]

Brassoud

[11] Patent Number: 4,536,922

[45] Date of Patent: Aug. 27, 1985

[54] ATTACHMENT DEVICE FOR A DECORATIVE ARTICLE

[75] Inventor: Gerard Brassoud, Faverges, France

[73] Assignee: S. T. Dupont, Paris, France

[21] Appl. No.: 549,343

[22] Filed: Nov. 4, 1983

[30] Foreign Application Priority Data

Nov. 4, 1982 [FR] France ..... 82 18501

[51] Int. Cl.[3] ..... A44C 5/18

[52] U.S. Cl. ..... 24/265 B; 24/265 AL; 24/265 WS; 411/337; 411/338

[58] Field of Search ..... 24/265 B, 265 R, 265 EC, 24/265 AL, 265 WS; 411/337, 338

[56] References Cited

U.S. PATENT DOCUMENTS

| | | | |
|---|---|---|---|
| 1,508,822 | 9/1924 | Schade | 411/338 |
| 1,976,198 | 10/1934 | Steenrod | 411/338 |
| 2,058,718 | 10/1936 | Peterson | 411/338 |
| 2,440,038 | 4/1948 | Baker et al. | 411/338 |
| 2,659,122 | 11/1953 | Golubics | 411/338 |
| 2,846,746 | 8/1958 | Webster et al. | 24/265 AL |
| 2,990,598 | 7/1961 | Gaylord | 411/337 |
| 3,837,048 | 9/1974 | Lewis et al. | 24/265 B |
| 4,017,946 | 4/1977 | Soja | 24/265 AL |
| 4,041,580 | 8/1977 | Turner | 24/265 AL |

*Primary Examiner*—Victor N. Sakran

*Attorney, Agent, or Firm*—Raymond J. De Vellis

[57] ABSTRACT

An attachment device for attaching a strap to a decorative article which includes a lateral support provided on the article and having a throughgoing bore, a loop portion provided on the strap, a shaft slidably mounted in the bore and passing through the loop, the shaft having an enlarged head portion on one end thereof, a spring for biasing the head portion away from the lateral support, and removable locking means for engaging the other end of the shaft to prevent withdrawal of the shaft from the bore, the shaft being movable between a first position wherein the locking means is positioned outside the attachment device for removal thereof and a second position wherein the locking device is moved by the spring to within the attachment device and is therefore substantially nonaccessible.

14 Claims, 14 Drawing Figures

ATTACHMENT DEVICE FOR A DECORATIVE ARTICLE

BACKGROUND OF THE INVENTION

1. Field of the Invention

This invention relates to an attachment device for attaching a strap to a decorative article, most particularly a wristwatch or a belt buckle.

2. Description of the Prior Art

A watchband is conventionally attached to a watchcase through the provision of two lateral supports integral with the watchcase and a telescoping shaft, the opposing ends of which fit into the two supports and around which the band is wrapped.

Such an attachment device is relatively secure and easily manufactured. However, it imposes certain limitations on the appearance of the article because of the necessity of using a support on each side of the watchcase.

To overcome this limitation, the present applicant has proposed, in French Patent Application Ser. No. 79 02 743, filed Feb. 2, 1979, an attachment device wherein the supports are concealed from view when the decorative article is being worn. Conventional telescoping shafts are not well adapted, however, for use in such an attachment device.

SUMMARY OF THE INVENTION

The present invention provides an attachment device for use on a decorative article wherein the supports are concealed from view when the article is being worn, such as is shown in the above-mentioned patent application.

In general, the invention features an attachment device for attaching a strap to a decorative article which includes a lateral support provided on the article and having a throughgoing bore, a loop portion provided on the strap, a shaft slidably mounted in the bore and passing through the loop, the shaft having an enlarged head portion on one end thereof, a spring for biasing the head portion away from the lateral support, and removable locking means for engaging the other end of the shaft to prevent withdrawal of the shaft from the bore, the shaft being movable between a first position wherein the locking means is positioned outside the attachment device for removal thereof and a second position wherein the locking device is moved by the spring to within the attachment device and is therefore substantially nonaccessible.

With a device according to the invention, two successive actions are therefore required to accomplish the removal of the band: Initially, the shaft must be displaced longitudinally, in order to make the removable locking element which is integral with the axis, accessible, this being done against elastic means; and secondly, the removal of the locking element. The invention therefore provides considerable security, since impacts, vibrations and other natural stresses to which the device is subjected in the course of its normal use will not produce the two operations required for its removal.

The element can be locked in the abutting position by the lateral support or by elements internal to the band. However, in an especially preferred embodiment of the invention, it is locked by the band itself.

We turn now to a description of the preferred embodiments, after first briefly describing the drawings, wherein:

DESCRIPTION OF THE PREFERRED EMBODIMENTS

Figure 1:
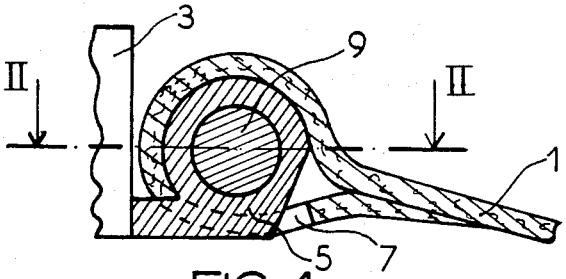
FIG. 1 is a partial cross section along line I—I in FIG. 2 of a watch case and watch strap, equipped with a first embodiment of an attachment device according to the invention.
Figure 4:
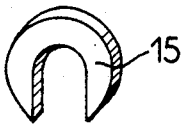
FIG. 4 is a detailed view of the removable locking element used in the embodiment shown in FIGS. 1 to 3.

Referring now to FIGS. 1–4 showing an attachment device according to the present invention being used to secure a watchstrap 1 to a watchcase 3, watchcase 3 is provided on two of its opposing edges (only one of which is shown, the other edge being a mirror image thereof) with a lateral support 5.

Band 1 is a wrapped around support 5 (i.e., is provided with a "loop"), and is provided with a cutaway slot 7 to accommodate support 5. Band 1 is retained on support 5 by a shaft 9 which passes through both elements. One end of shaft 9 is provided with an enlarged head portion 11, while the opposing end has a circular groove 13 dimensioned to receive a stop consisting of a slotted washer 15 shown in FIG. 4.

Figure 2:
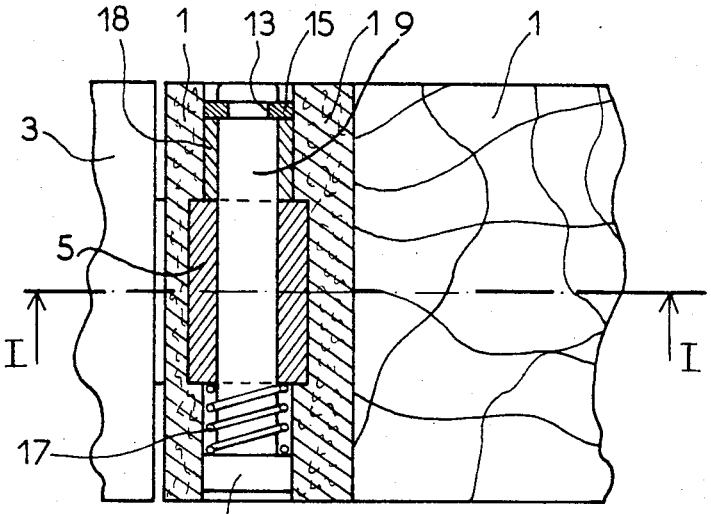
FIGS. 2 and 3 are partial sections along line II—II of the device shown in FIG. 1, shown in the wearing position and in the operating position, respectively.

Referring most particularly to FIG. 2, a compression spring 17 and a sleeve 18 are slipped over the opposite ends of shaft 9, with spring 17 being contained between head 11 and one side of support 5 and with sleeve 18 being contained between slotted washer 15 and the opposing side of support 5.

Figure 3:
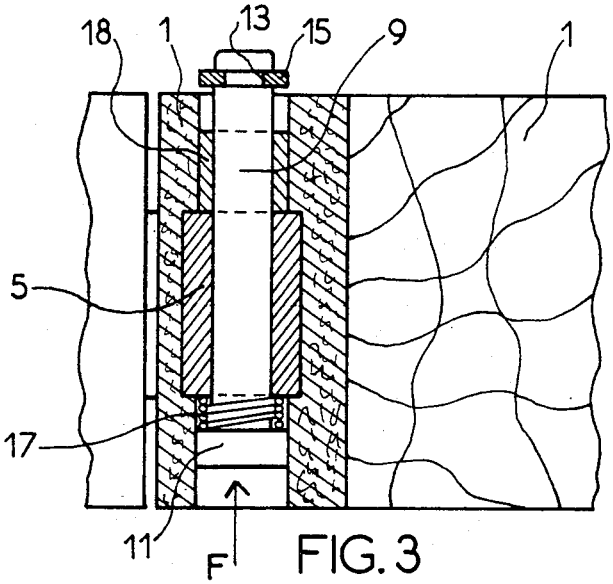

Referring most particularly to FIG. 3, the watchband is installed on the watchcase using the attachment device of FIGS. 1–4 by first positioning band 1 over support 5 (with support 5 passing upwards through cutaway slot 7). Shaft 9, equipped with spring 17, is then passed through support 5 and the loop of band 1, and sleeve 18 is installed. The user then exerts a force F on head 11 to displace shaft 9 against the force of spring 17 so as to move groove 13 outside of the loop in band 1. Slotted washer 15 is engaged in groove 13, and the force F exerted on shaft 9 is released, causing slotted washer 15 to be retracted within the loop of band 1 and to abut sleeve 18 under the influence of spring 17. The device is then in the wearing position, wherein slotted washer 15 is contained on all sides by the loop provided in band 1. The band therefore locks the attachment device as shown in FIG. 2.

To disengage band 1, pressure must be exerted on shaft 9 to move groove 13 and slotted washer 15 outside of the loop of band 1. Accordingly, a fastening device according to the present invention is particularly reliable, since neither relatively mild impact forces nor natural movements of the band will produce sufficient displacement of shaft 9 to cause disengagement.

Figure 5:
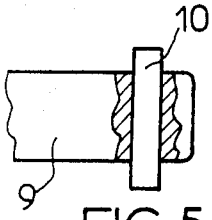
FIGS. 5, 6 and 7 show various embodiments of a removable locking element of an attachment device according to the invention.
Figure 6:
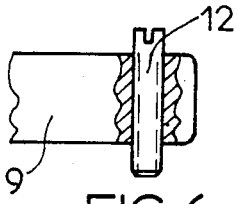
Figure 7:
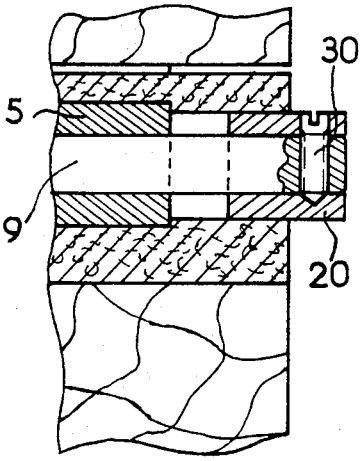

Other fastening devices may be employed in place of slotted washer 15. Thus, FIG. 5 shows a pin 10 passed through a transverse bore provided in shaft 9, while FIG. 6 shows a screw 12 threaded into such a transverse bore. Additionally, as shown in FIG. 7, a sleeve 20 may be utilized as a stop. In this embodiment, a screw 30 fixes sleeve 20 to shaft 9.

Figure 8:
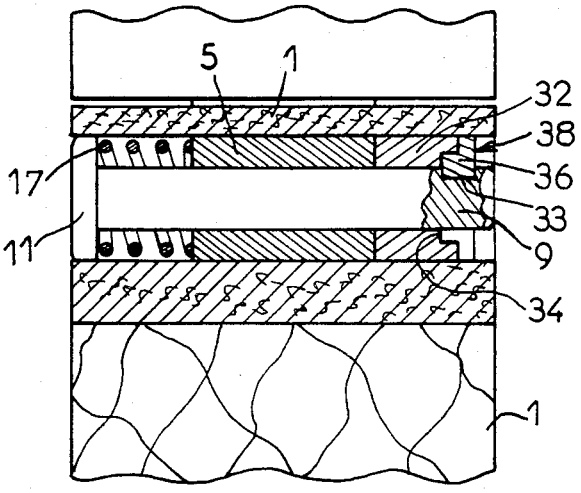
FIG. 8 is a partial cross section through a watch case and band equipped with an embodiment of a device according to the invention wherein the element is held in position by a sleeve internal to the band.
Figure 9:
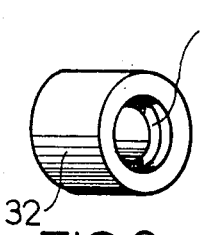
FIGS. 9 and 10 are perspective views of the sleeve and an associated locking element used in the embodiment shown in FIG. 8.
Figure 10:
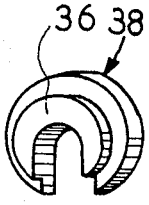

In another embodiment of the invention, the stop is made inaccessible (or locked in place in the wearing position) by an element other than the band. Thus, as shown in FIGS. 8–10, a hollow sleeve 32 is provided with a counterbore 34 dimensioned to receive an outstanding semicircular shoulder 36 formed on a slotted washer 38. As shown in FIG. 8, in the wearing position, slotted washer 38 is fitted into a groove 33 provided at the end of shaft 9, and shoulder 36, under the influence of spring 17, is forced into counterbore 34, thus preventing removal of slotted washer 38 in the wearing position.

Figure 11:
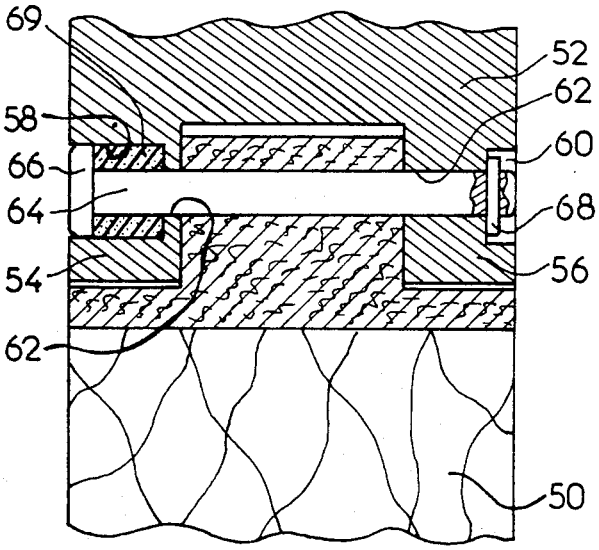
FIG. 11 is a partial section through another embodiment of an attachment device according to the invention, applied to the attachment of a strap to a belt buckle.

An attachment device according to the present invention can be used to fasten a strap onto any sort of decorative article. Thus, FIG. 11 illustrates an application of the present invention in attaching a strap 50 to a belt buckle 52. Buckle 52 is provided with two lateral supports 54 and 56 pierced by two chambers 58 and 60 and a bore 62 dimensioned to receive a shaft 64.

Figure 12:
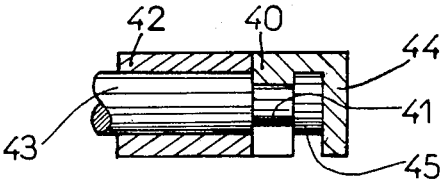
FIG. 12 is a longitudinal section through yet another embodiment, wherein the removable element is composed of a split washer hidden from sight.

Strap 50 is provided with two cutaway portions dimensioned to accommodate supports 54. Strap 50 fits between supports 54 and 56 and is held in this position by shaft 64 around which it is looped. One end of shaft 64 is provided with an oversized head portion 66, while a transverse hole dimensioned to receive a key 68 is provided at its other end. An elastic foam sleeve 69 is disposed between head 66 and the bottom of chamber 58. Sleeve 69, being elastic, ensures security of the device in the wearing position by pressing key 68 against the bottom of chamber 60. So positioned, key 68 is locked in position by the sides of chamber 60, and the device is guarded against accidental disengagement.As shown in FIG. 12, the removable locking element can consist of a slotted washer 40 which engages a groove 41 of a shaft 43. Washer 40 is provided with an integral disk 44 which conceals the end 45 of shaft 43 from view.

Figure 13:
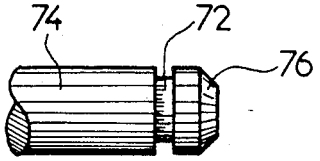
FIGS. 13 and 14 are detailed views of the shaft and of the removable element, in an embodiment of an attachment device according to the invention which allows installation when the shaft is in the wearing position.
Figure 14:
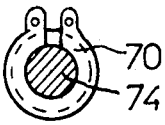

In another embodiment shown in FIGS. 13 and 14, the removable locking element can be a circlip 70 which snaps into a circular groove 72 provided on a shaft 74. The end 76 of shaft 74 may be conically shaped to permit installation of circlip 70 without having to position circular groove 72 outside of the strap or support.

While the present invention has been described by way of a number of preferred embodiments, various substitutions of equivalents may be effected without departing from the scope or spirit of the accompanying claims.

What is desired to be secured and protected by Letters Patent of the United States is:

1. An attachment device for attaching a strap to a decorative article, comprising:

at least one lateral support provided on said article, said lateral support being provided with a throughgoing bore;

a loop portion formed on said strap;

a shaft slidably mounted in said throughgoing bore of said lateral support, said shaft also passing through said loop portion of said strap;

an enlarged head portion provided on a first end of said shaft;

biasing means for biasing said head portion on said first shaft end away from said lateral support; and removable locking means for engaging a second end of said shaft and thereby preventing withdrawal of said shaft from said bore provided in said lateral support;

said shaft being movable between two extreme positions under the biasing action of said biasing means, a first position achieved by moving said shaft against said biasing force and wherein said removable locking means is accessible outside of said attachment device for removal thereof, and a second position achieved by displacement of said shaft under the influence of and in the direction of said biasing force and wherein said locking means is secured and withdrawn to a position interior to said attachment device and is therefore substantially nonaccessible.

2. A device according to claim 1, further comprising a spacing element mounted on said shaft and wherein, in said second position, said removable locking means is biased against said spacing element under the influence of said biasing means.

3. A device according to claim 2, wherein, in said second position, said locking means is disposed within and locked by said loop portion.

4. A device according to claim 2, wherein said second end of said shaft is provided with a groove and wherein said removable locking means comprises a slotted washer adapted to engage said groove.

5. A device according to claim 2, wherein said second end of said shaft is provided with a groove and wherein said removable locking means comprises a circlip adapted to engage said groove.

6. A device according to claim 2, wherein said second end of said second end of said shaft is provided with a transverse bore and wherein said removable locking means comprises a attachment means adapted to fit into said bore.

7. A device according to claim 2, wherein said removable locking means comprising a sleeve coaxial with and removably attached to said second end of said shaft.

8. A device according to claim 1, wherein, in said second position, said locking means is disposed within and locked by a recess provided in the surface of said lateral support.

9. A device according to claim 8, wherein said second end of said shaft is provided with a groove and wherein said removable locking means comprises a circlip adapted to engage said groove.

10. A device according to claim 2, wherein said spacing element comprises a sleeve coaxial with said shaft and wherein, in said second position, said removable locking means is engaged by and locked by said sleeve.

11. A device according to claim 10, wherein said second end of said shaft is provided with a groove, wherein said sleeve is provided with a counterbore 34, and wherein said locking element comprises a slotted washer adapted to engage said groove, said slotted washer having an outstanding shoulder portion for engaging said counterbore.

12. A device according to claim 8, wherein said second end of said shaft is provided with a groove and wherein said locking element comprises a slotted portion (40) adapted to engage said groove and further including a disk 44 integral with said slotted portion for concealing said second end of said shaft from view.

13. An attachment device for attaching a strap to a decorative article, comprising:

at least one lateral support provided on said article, said laterial support being provided with a throughgoing bore;

a loop portion formed on said strap;

a shaft slidably mounted in said throughgoing bore of said lateral support, said shaft also passing through said loop portion of said strap;

an enlarged head portion provided on a first end of said shaft;

biasing means for biasing said head portion on said first shaft end away from said lateral support;

removable locking means for engaging a second end of said shaft and thereby preventing withdrawal of said shaft from said bore provided in said laterial support, said second end of said shaft being provided with a groove, and said sleeve being provided with a counterbore 34, said locking means including a slotted washer adapted to engage said groove, said slotted washer having an outstanding shoulder portion for engaging said counterbore;

said shaft being movable between two extreme positions under the biasing action of said biasing means, a first position achieved by moving said shaft against said biasing force and wherein said removable locking means is accessible outside of said attachment device for removal thereof, and a second position achieved by displacement of said shaft under the influence of and in the direction of said biasing force and wherein said locking means is withdrawn to a position interior to said attachment device and is therefore substantially nonaccessible; and a spacing element mounted on said shaft and wherein, in said second position, said removable locking means is biased against said spacing element under the influence of said biasing means, said spacing element forming a sleeve coaxial with said shaft and wherein, in said second position, said removable locking means is engaged by and locked by said sleeve.

14. A device according to claim 13 further including a disk 44 integral with said slotted washer for concealing said second end of said shaft from view.

* * * * *